US007482748B2

(12) United States Patent
Chang et al.

(10) Patent No.: US 7,482,748 B2
(45) Date of Patent: Jan. 27, 2009

(54) PLASMA DISPLAY PANEL WITH PASTE COMPOSITE FOR WHITE-BLACK FORMATION

(75) Inventors: Sung Ho Chang, Kumi-shi (KR); Seung Tea Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/871,568

(22) Filed: Jun. 21, 2004

(65) Prior Publication Data

US 2004/0256988 A1 Dec. 23, 2004

(30) Foreign Application Priority Data

Jun. 23, 2003 (KR) ..... 10-2003-0040857

(51) Int. Cl.
*H01J 17/49* (2006.01)

(52) U.S. Cl. ..... 313/582; 313/586

(58) Field of Classification Search ..... 313/582–587
See application file for complete search history.

(56) References Cited

U.S. PATENT DOCUMENTS 5,264,758 A * 11/1993 Iijima et al. ..... 313/584
5,635,334 A * 6/1997 Borland et al. ..... 430/311
5,909,083 A * 6/1999 Asano et al. ..... 313/584
6,008,582 A * 12/1999 Asano et al. ..... 313/582
6,050,107 A * 4/2000 Toyoda et al. ..... 65/17.6
6,344,714 B1 * 2/2002 Su et al. ..... 313/582
6,692,885 B2 * 2/2004 Lee ..... 430/198
7,138,965 B2 * 11/2006 Shiiki et al. ..... 345/60

FOREIGN PATENT DOCUMENTS

| | | |
|---|---|---|
| JP | 10-144206 | 5/1998 |
| JP | 11-011979 | 1/1999 |
| JP | 11-292561 | 10/1999 |
| JP | 2001-0529603 | 2/2001 |
| JP | 2002-069381 | 3/2002 |
| JP | 2002-069381 | 8/2002 |
| JP | 2002-324484 | 11/2002 |
| JP | 2003-104756 | 4/2003 |
| KR | 10-2003-0037727 A | 5/2003 |

OTHER PUBLICATIONS

Korean Office Action dated Mar. 8, 2005.

* cited by examiner

*Primary Examiner*—Nimeshkumar D Patel
*Assistant Examiner*—Anne M Hines
(74) *Attorney, Agent, or Firm*—Ked & Associates, LLP

(57) ABSTRACT

A paste composite for a white back formation and a plasma display panel using the same and a fabricating method thereof capable of improving an abrasion resistance of the white-back and reducing a processing time and a processing cost is disclosed. The paste composite for the white back formation includes at least one of a resin of 2 weight % to 15 weight % and a plasticizer of 0.0001 weight % to 2 weight %, a powder of 65 weight % to 75 weight %, and a solvent of 25 weight % to 35 weight %.

16 Claims, 16 Drawing Sheets

PLASMA DISPLAY PANEL WITH PASTE COMPOSITE FOR WHITE-BLACK FORMATION

This application claims the benefit of Korean Patent Application No. P2003-40857 filed in Korea on Jun. 23, 2003, which is hereby incorporated by reference.

BACKGROUND OF THE INVENTION

1. Field of the Invention

The present invention relates to a plasma display panel, and more particularly, to a paste composite for a white back formation and a plasma display panel using the same and a fabricating method thereof capable of improving an abrasion resistance of the white-back and reducing a processing time and a processing cost.

2. Description of the Related Art

In recent, there have been actively developed flat display devices such as a liquid crystal display (LCD), a field emission display (FED), a plasma display panel (PDP) and the like. Among these flat display devices, the PDP has advantages that it permits an easier manufacturing according to its simple structure, and a higher efficiency in brightness and a light emission in comparison with other flat display devices. Further, the PDP has advantages that it has not only a memory function, a wide view angle more than 160°, but also it permits an implementation of a large-scale screen more than 40 inches.

FIGS. 1A to 1H are diagrams stepwise illustrating a method of fabricating a lower plate of a related art plasma display panel.

First of all, as shown in FIG. 1A, a glass substrate 11 is prepared and then a paste 12 for a white-back formation is formed by a printing method or a coating method on the glass substrate 11. In this case, it is preferable that a lower plate electrode (for instance, an address electrode (not shown)) is formed on the glass substrate 11 by using a printing method, an additive method and a photosensitive paste before coating the paste 12 for the white-back formation.

Subsequently, as shown in FIG. 1B, the paste 12 for the white-back formation is dried and baked to form a white-back 12*a*. Herein, the white-back 12*a* serves as a reflective film to reflect a visible ray to thereby improve a light emission efficiency. In addition, the white-back 12*a* serves as an insulating film for protecting the lower plate electrode upon a discharge and preventing a short of the lower plate electrode. The paste 12 for forming the white-back 12*a* is made of a mixture containing a powder of approximately 65 weight % to 75 weight %, a resin of approximately 2 weight % to 3 weight % and a solvent of approximately 25 weight % to 35 weight %. The powder and the resin include a variety of materials upon their uses. The variety of materials is widely known in the art, and therefore, an explanation therefore will be omitted.

As shown in FIG. 1C, on the glass substrate 11 provided with the white-back 12*a*, a paste 13 for forming a barrier is formed by a printing method or a coating method in order to make a barrier rib with a designated height. The paste 13 for the barrier formation is made of a mixture containing a power having a parent glass ($PbO—SiO_2—Al_2O_3$ system), a filer ($Al_2O_3$) and a pigment ($TiO_2$), a resin for making an easy attachment of the barrier ribs to the glass substrate or the white-back, and a solvent.

Subsequently, a dry film resist (DFR) is formed by a laminating method on the paste 13. Thereafter, the dry film resist is then patterned through exposure and developing processes, to thereby form a dry film resist pattern 14, as shown in FIG. 1D.

Subsequently, a sandblasting by using the dry film resist pattern 14 as a mask forms a barrier rib 13*a*, as shown in FIG. 1E.

After forming the barrier rib 13*a*, a wet-etching process using a stripper, that is, an alkaline solution such as NaOH, is performed in the dry film resist pattern 14. As a result, as shown in FIG. 1F, the dry film resist is removed (stripped).

Subsequently, as shown in FIG. 1G, the barrier rib 13*a* formed on the glass substrate 11 is baked.

Thereafter, as shown in FIG. 1H, a phosphor material is coated along an inner wall of the barrier rib 13*a* by the printing method, to thereby form a phosphor 15. Accordingly, the lower plate of the plasma display panel is fabricated.

As described above, the related art method of fabricating the lower plate performs the baking process, to thereby enhancing the abrasion resistance when forming the white-back. Accordingly, the white-back can be protected from an impact due to an abrasive and thus the lower plate electrode can be protected upon forming the barrier rib by the sand blasting.

However, when the white-back and the barrier rib are formed, they are baked separately. Accordingly, since the baking process is repeatedly performed, the processing time and a processing cost is increased by the repetition of the baking process, which entails a lower production yield.

SUMMARY OF THE INVENTION

Accordingly, it is an object of the present invention to provide paste composite for forming a white-back without requiring a separate baking process by adding a plasticizer or increasing a content of a resin to improve an abrasion resistance of the white-back.

It is another object of the present invention to provide a plasma display panel and a method of fabricating the same capable of reducing a processing time and cost by using paste composite for a white-back formation with an improved an abrasion resistance without requiring a separate baking process.

In order to achieve these and other objects of the invention, the paste composite for a white-back formation of a plasma display panel includes: at least one of a resin of 2 weight % to 15 weight % and a plasticizer of 0.0001 weight % to 2 weight %, a powder of 65 weight % to 75 weight %, and a solvent of 25 weight % to 35 weight %.

The resin has a content of 4 weight % to 15 weight %.

The resin has a content of 2 weight % to 3 weight %.

The plasticizer includes at least one of a dioctyl phthalate (DOP) and a dibutyl phthalate (DBP).

The resin includes at least one of ethyl cellulose and acryl.

A plasma display panel includes: an address electrode formed on a substrate; and a white-back formed to cover the address electrode, wherein the white-back including at least one of a resin of 2 weight % to 15 weight % and a plasticizer of 0.0001 weight % to 2 weight %, a power of 65 weight % to 75 weight %, and a solvent of 25 weight % to 35 weight %.

The plasma display panel further includes: barrier ribs formed on the white-back; and a phosphor coated on the barrier ribs and the white-back.

A method of fabricating a plasma display panel includes: forming a white-back by applying a paste for a white-back formation on a substrate and drying the paste; applying a paste for a barrier rib formation on the substrate having the white-back and drying the paste; forming a dry film resist pattern on the coated and the dried paste for the barrier rib formation; forming barrier ribs by sand blasting using the dry film resist pattern as a mask; and simultaneously baking the white-back and the barrier ribs.

The method further includes forming an address electrode on the substrate before forming the white-back.

The method further includes applying a phosphor along an inner surface of the barrier ribs after the baking process.

The paste for the white-back formation includes at least one of a resin of 2 weight % to 15 weight % and a plasticizer of 0.0001 weight % to 2 weight %, a power of 65 weight % to 75 weight %, and a solvent of 25 weight % to 35 weight %.

The baking process is performed at 530° C. to 570° C. for 20 minutes to 30 minutes.

BRIEF DESCRIPTION OF THE DRAWINGS

These and other objects of the invention will be apparent from the following detailed description of the embodiment of the present invention with reference to the accompanying drawings, in which.

DETAILED DESCRIPTION OF THE PREFERRED EMBODIMENT

Figure 1A:
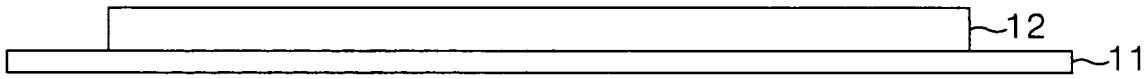
FIG.1A RELATED ART
FIGS. 1A to 1H are diagrams stepwise illustrating a method of fabricating a lower plate of a related art plasma display panel.
Figure 1B:
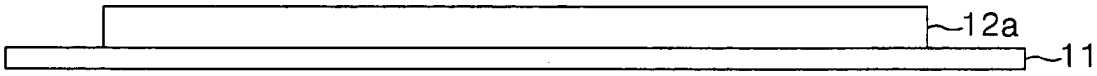
FIG.1B RELATED ART
Figure 1C:
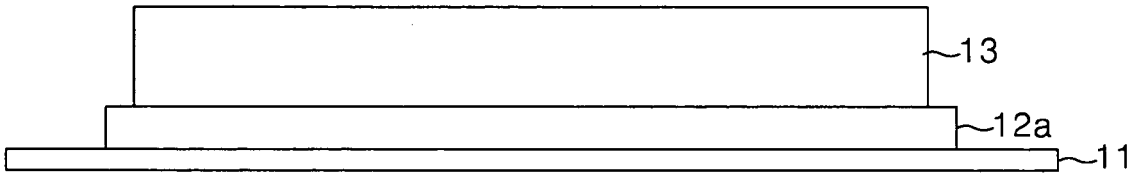
FIG.1C RELATED ART
Figure 1D:
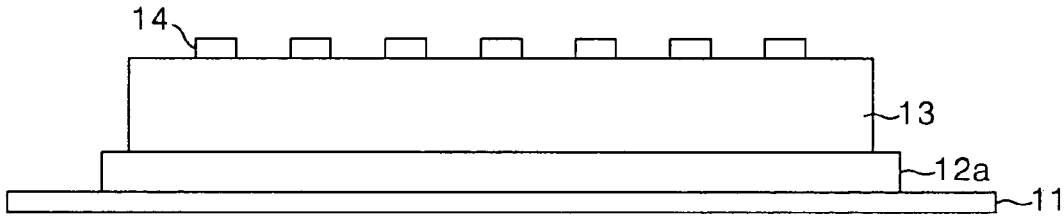
FIG.1D RELATED ART
Figure 1E:
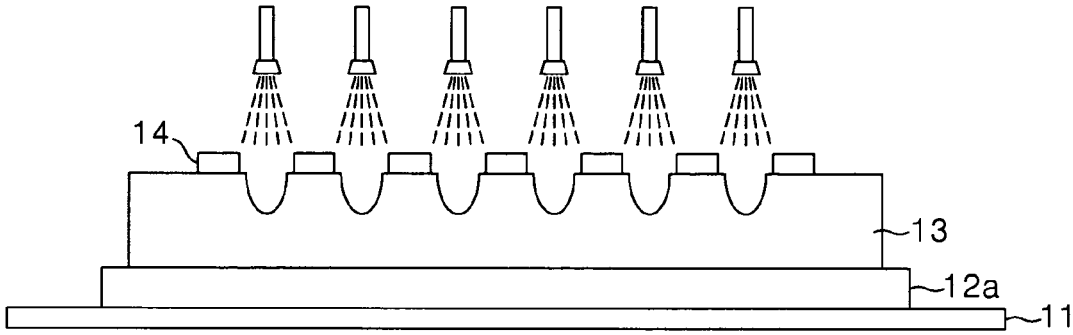
FIG.1E RELATED ART
Figure 1F:
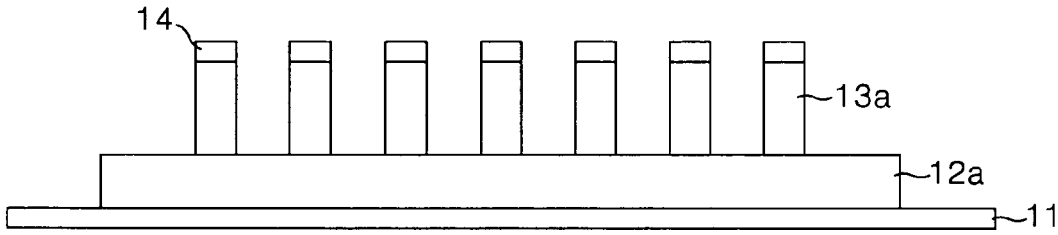
FIG.1F RELATED ART
Figure 1G:
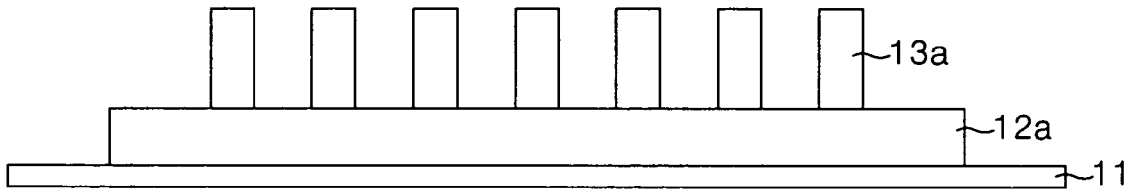
FIG. 1G RELATED ART
Figure 1H:
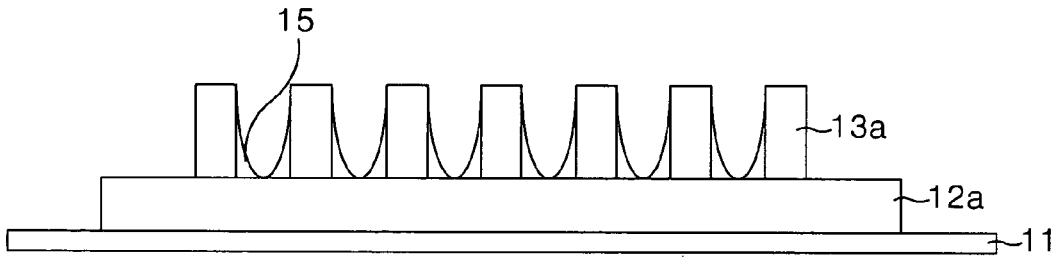
FIG.1H RELATED ART

Reference will now be made in detail to the preferred embodiments of the present invention, examples of which are illustrated in the accompanying drawing.

Hereinafter, the preferred embodiments of the present invention will be described in detail with reference to FIGS. 2 to 3G.

Herein below, preferable paste composite for a white-back formation and a method of fabricating a plasma display panel using the same will be described. In the present invention, constitutions identical to those of the related art will be assigned by the same reference numerals.

The present invention proposes a method capable of reducing processing time and coat by abbreviating a separate baking process using the paste composite for the white-back formation in case of forming a white-back by differentiating the paste composite in order to provide an improve abrasion resistance.

To this end, the paste composite for the white-back formation can be represented in a variety of examples as follows.

EXAMPLE 1

According to a first embodiment of the present invention, a paste composite for a white-back formation consists of a powder of 65 weight % to 75 weight %, a resin of 4 weight % to 15 weight %, and a solvent of 25 weight % to 35 weight %.

A content of the resin is raised by two times to seventh times as compared with 2 weight % to 3 weight % of the related art, thereby improving an abrasion resistance of a white-back. In this case, the resin includes any one of ethyl cellulose and acryl.

In other words, raising a content of the resin strengthens a coherence of the powder. Accordingly, even though the white-back is inflicted by an impact of an abrasive, particles of the powder are not easily separated. Thus, the white-back is not damaged.

Accordingly, because the white-back is formed by using the paste composite for the white-back formation, a baking process is not required to form the white-back. Thus, it is possible to reduce processing time and cost.

EXAMPLE 2

According to a second embodiment of the present invention, paste composite for a white-back formation consists of a powder of 65 weight % to 75 weight %, a resin of 2 weight % to 3 weight %, a plasticizer of 0.0001 weight % to 2 weight %, and a solvent of 25 weight % to 35 weight %. That is, the plasticizer of 0.0001 weight % to 2 weight % is added instead of the resin of 2 weight % to 3 weight % in the related art. By forming a white-back using the paste composite for white-back formation as described above, a softness of the white-back as well as a repulsive power of the white-back is raised by the added plasticizer. Accordingly, the white-back has an improved abrasion resistance against an abrasive during a sand blasting upon forming the barrier rib. Thus, the white-back get not damaged. At this time, the added plasticizer includes any one of dioctyl phthalate and dibutyl phthalate.

EXAMPLE 3

According to a third embodiment of the present invention, paste composite for a white-back formation consists of a powder of 65 weight % to 75 weight %, a resin of 4 weight % to 15 weight %, a plasticizer of 0.0001 weight % to 2 weight %, and a solvent of 25 weight % to 35 weight %. The Example 3 incorporates the Example 1 and the Example 2. That is, in the Example 3, the content of the resin is raised by two times to seventh times as compared with the related art and the plasticizer is added in an amount of about 0.0001 weight % to 2 weight %.

By forming a white-back with the paste composite as described in the Example 3, the white-back has an improved abrasion resistance as similar as the Example 1 and the Example 2.

Hereinafter, a plasma display panel using the paste composite for the white-back formation suggested in the Example 1 to the Example 3 will be described with reference to FIG. 2.

Figure 2:
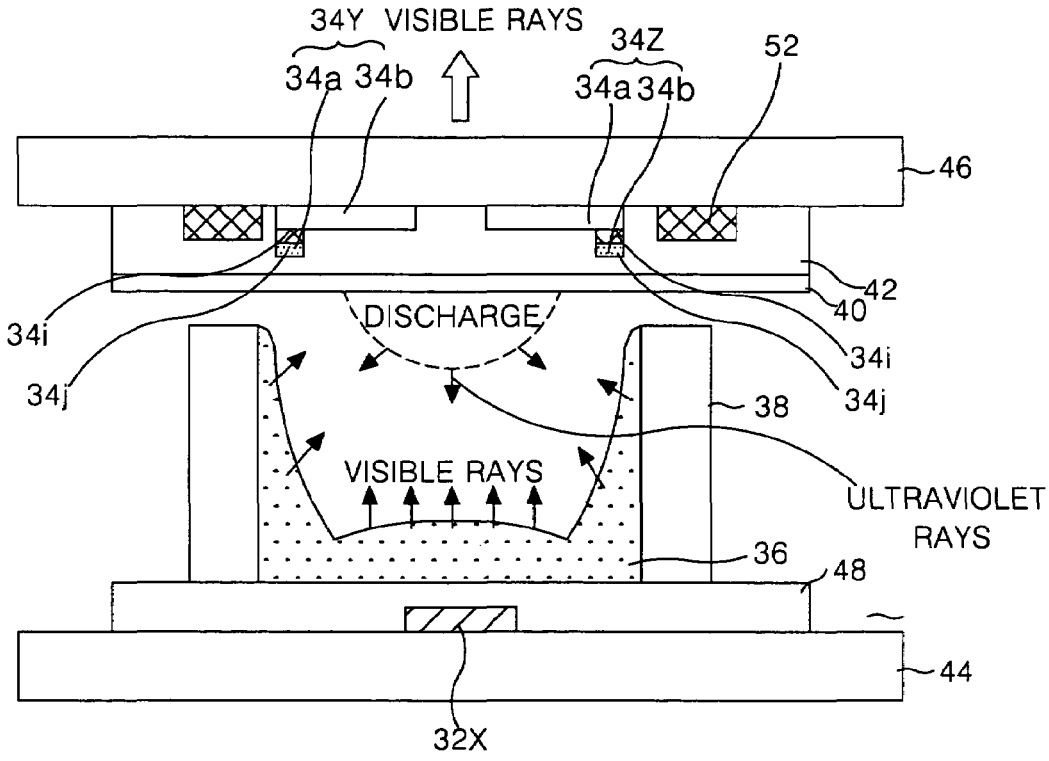
FIG. 2 is configuration showing a plasma display panel according to the present invention.

FIG. 2 shows a configuration of a discharge cell of a plasma display panel according to the present invention.

In the plasma display panel shown in FIG. 2, an upper plate includes an upper substrate 46 having a scan/sustain electrode 34Y and a common sustain electrode 34Z, and a lower substrate having an address electrode 32X. FIG. 2 shows the lower plate rotated by the angle of 90°. An inactive gas for a gas discharge is injected into a discharge space defined between the upper substrate 46, the lower substrate and a barrier rib 38.

A pair of sustain electrodes 34Y and 34Z has a transparent electrode 34*a* and a bus electrode 34*b*. The transparent electrode 34*a* is made of a transparent conductive material in order to transmit light provided from a discharge cell of the transparent electrode 34*a*. The bus electrode 34*b* is formed with a structure of a double-layer having a black layer 34*i* and an electrode layer 34*j*.

The electrode layer 34*j* includes a silver Ag with a high conductivity. The electrode layer 34*j* serves to compensate a low conductivity of the transparent electrode 34*b*. The black layer 34*i* with a low conductivity is formed between the transparent electrode 34*b* and the electrode layer 34*j*. The black layer 34*i* prevents a discoloration of the electrode layer 34*j* and improves a contrast of a plasma display panel.

On the upper substrate 46 in which the scan/sustain electrode 34Y is formed in parallel to the common sustain electrode 34Z, an upper dielectric layer 42 and a protective film 40 are disposed. Wall charges generated upon a gas discharge are accumulated in the upper dielectric layer 42.

The protective film 40 prevents a damage of the upper dielectric layer 42 caused by the sputtering upon the gas discharge and improves the emission efficiency of secondary electrons. This protective film 42 is usually made of magnesium oxide MgO.

On the upper dielectric layer 42 of the plasma display panel, a black matrix is formed in a direction parallel to the pair of the sustain electrodes 34Y and 34Z in order to improve a contrast of a screen. The black matrix 52 absorbs an external light and an inner transmitted light between adjacent cells, to thereby improve a saturation and a contrast.

A white-back (or a lower dielectric layer) 48 and barrier ribs 38 are formed on the lower substrate 44 provided with the address electrode 32X, and a phosphor layer 36 is coated on the surfaces of the white-back 48 and the barrier ribs 38. The address electrode 32X is formed in a direction crossing the scan/sustain electrode 34Y and the common sustain electrode 34Z.

The barrier ribs 38 are formed in parallel to the address electrode 32X to prevent an ultraviolet ray and a visible light generated upon the discharge from being leaked to the adjacent discharge cells.

The phosphor layer 36 is excited by the ultraviolet ray generated upon the discharge to produce one of a red, green or blue color visible light ray.

As observed in the Example 1 to the Example 3, the white-back 48 has an improved abrasion resistance by employing the resin of 4 weight % to 15 weight % raised by two times to seventh times as compared with the related art (see, the Example 1), by adding the plasticizer of about 0.0001 weight % to 2 weight % while maintaining the same content of the paste composite for the white-back formation as the related art (see, the Example 2), or by raising the content of the resin as compared with the related art and adding the plasticizer (see, the Example 3) Hereinafter, a method of fabricating the plasma display panel shown in FIG. 2 suggested in the Example 1 to the Example 3 will be described with reference to FIGS. 3A to 3G.

Figure 3A:
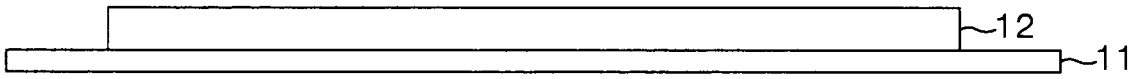
FIGS. 3A to 3G are diagrams stepwise illustrating a method of fabricating a lower plate of a plasma display panel according to the present invention.

First of all, as shown in FIG. 3A, a glass substrate 11 is prepared and then a paste 12 for a white-back formation is formed by a printing method or a coating method on the glass substrate 11. Meanwhile, it is preferable that, before coating the paste 12 for the white-back formation, a lower plate electrode (for instance, an address electrode (not shown)) is formed by using a printing method, an additive method and a photosensitive paste on the glass substrate 11.

Subsequently, the paste 12 for the white-back formation is dried to form a white-back 12*a*. According to the present invention, the baking process following the drying process does not performed. To bake the coated paste in the related art is to prevent a damage due to an impact by an abrasive upon forming a barrier rib later. However, as observed in the Example 1 to the Example 3, because the present invention already endows the paste for the white-back formation with an improved abrasion resistance, a separate baking process is not required.

That is, according to the present invention, the white-back 48 has an improve abrasion resistance by employing the resin of 4 weight % to 15 weight % raised by two times to seventh times as compared with the related art (see, the Example 1), by adding the plasticizer of about 0.0001 weight % to 2 weight % while maintaining the same content of the paste composite for the white-back formation as the related art (see, the Example 2), or by raising the content of the resin as compared with the related art and adding the plasticizer (see, the Example 3).

Accordingly, because the white-back 12*a* is formed by using the paste for the white-back formation mixed with the composition as described above, the white-back can be prevented from being damaged by an abrasive upon forming a barrier rib later even though a separately baking process is abbreviated upon forming the white-back.

Meanwhile, the white-back 12*a* can be formed by using any one of a printing method and a coating method. Herein, as described in the related art, the white-back 12*a* serves as a reflective film to reflect a visible ray, thereby improving a light-emission efficiency. In addition, the white-back 12*a* serves as a insulating film for protecting the lower plate electrode upon a discharge and preventing a short of the lower plate electrode.

Figure 3B:
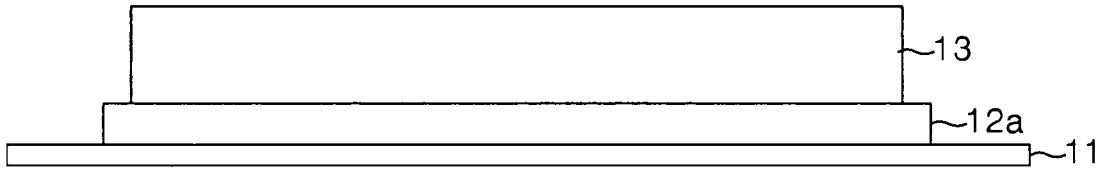

As shown in FIG. 3*b*, on the glass substrate 11 provided with the white-back 12*a*, a paste 13 for forming a barrier is formed by a printing method or a coating method in order to make a barrier rib with a designated height. The paste 13 for the barrier formation is made of a mixture containing of a powder having a parent glass ($PbO—SiO_2—Al_2O_3$ system), a filer ($Al_2O_3$) and a pigment ($TiO_2$), a resin for easily making an easy attachment of the barrier ribs to the glass substrate or the white-back, and a solvent. For instance, paste composite for the barrier rib formation consists of a powder of 75 weight % to 85 weight %, a resin of 1 weight % to 2 weight % and a solvent of 15 weight % to 25 weight %. Needless to say, it is apparent that a ratio of the paste composite for the barrier rib formation becomes differ depending on their applications.

Figure 3C:
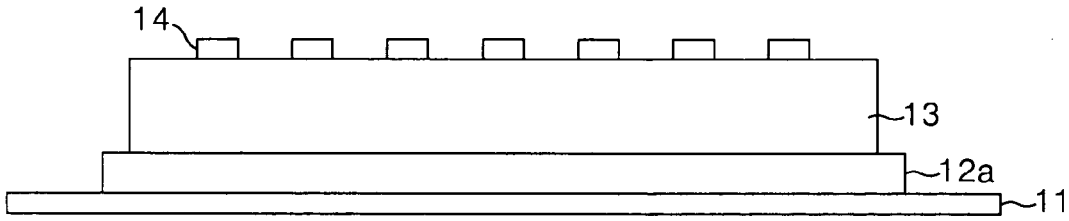

Subsequently, a dry film resist (DFR) is formed by a laminating method on the paste 13 for the barrier formation. Thereafter, the dry film resist is then patterned through exposure and developing processes, to thereby form a dry film resist pattern 14, as shown in FIG. 3C.

Figure 3D:
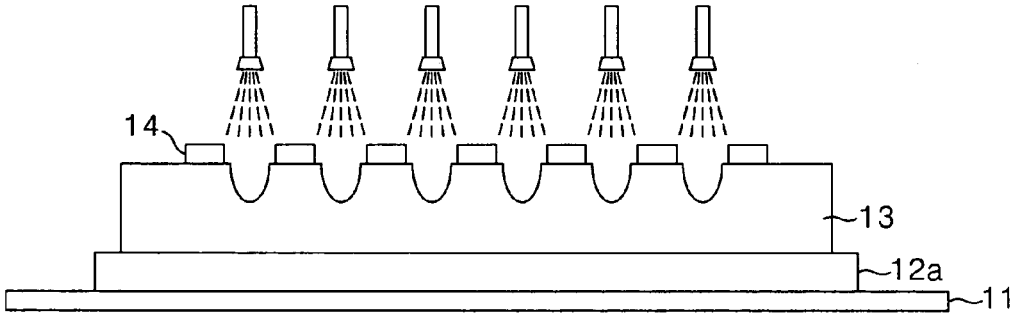

Subsequently, a sand blasting by using the dry film resist pattern 14 as a mask forms a barrier rib 13*a*, as shown in FIG. 3D.

Figure 3E:
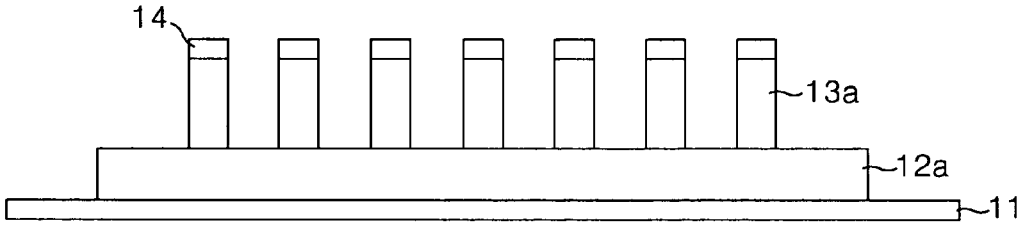

After forming the barrier rib 13*a*, a wet-etching process using a stripper agent, e.g., an alkaline solution such as NaOH, is performed with respect to the dry film resist pattern 14. As a result, as shown in FIG. 3*e*, the dry film resist is removed (stripped).

Figure 3F:
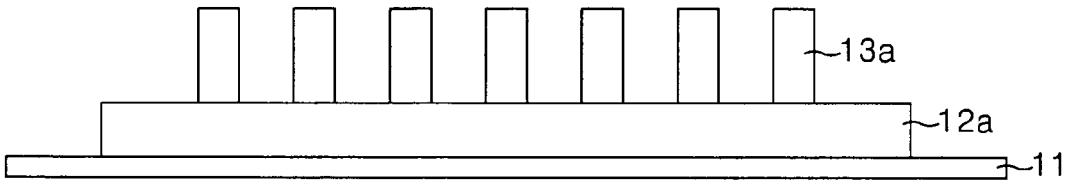

Subsequently, as shown in FIG. 3*f*, both of the white-back 12*a* and the barrier rib 13*a* formed on the glass substrate 11 are concurrently baked. At this time, it is preferable that the baking process is performed at 530° C. to 570° C. for 20 minutes to 30 minutes.

Figure 3G:
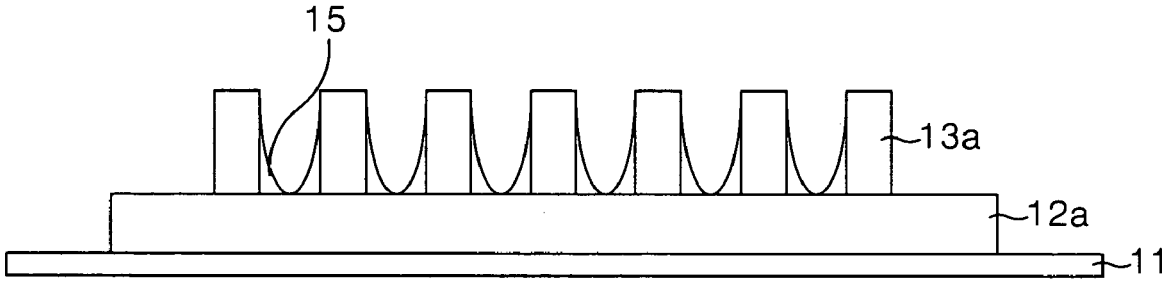

Thereafter, a phosphor 15 is coated along an inner wall of the barrier rib 13*a* by a printing method, to thereby form the phosphor 15 as shown in FIG. 3G. As a result, the lower plate of the plasma display panel according to the present invention is fabricated.

Accordingly, when the white-back is formed by using a paste for the white-back formation with an improved abrasion resistance upon fabricating the lower plate of the plasma display panel, a separate baking process needed for the white-back is not required and the whit-back get not damaged against an impact by the abrasive used to form the barrier rib.

As described above, according to the present invention, paste composite for a white-back formation attributes to make a paste for a white-back formation with an improved abrasion resistance by raising a content of a resin or adding a plasticizer.

Also, since the white-back is formed by using the paste for the white-back formation with an improved abrasion resistance, the white-back is prevented from being damaged against an impact by an abrasive used to form a barrier rib, to thereby ultimately protect a lower electrode and a substrate.

Further, according to the plasma display panel and the method of fabricating the same using paste composite for the white-back formation and according to the present invention, the white-back is formed by using the paste for the white-back formation with an improved abrasion resistance without requiring a baking process and the white-back is concurrently baked along with the barrier rib at the time of forming the barrier rib later. Accordingly, once baking processes can substitute for twice baking processes performed in the related art. Thus, it is possible to reduce a processing time and cost.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel comprising:

at least one address electrode formed on a first a substrate;

a white-back formed to cover the address electrode and the first substrate, wherein the white-back is made from a paste having a composition of at least one of a resin of 2weight % to 15 weight % and a plasticizer of 0.0001 weight % to 2 weight %, a powder of 65weight % to 75 weight %, and a solvent of 25 weight % to 35 weight %;

at least one barrier rib formed on the white-back, wherein the at least one barrier rib is made from a composition which is different from the white-back;

a phosphor coated on the at least one barrier rib and the white-back;

first and second electrodes formed on a second substrate;

a black matrix formed at least in a direction of the first and second electrodes, and the first and second electrodes being provided between the black matrix;

a dielectric layer provided on the first and second electrodes, the second substrate, and the black matrix; and a protective film provided on the dielectric layer.

2. The plasma display panel according to claim 1, wherein the resin has a content of 4 weight % to 15 weight %.

3. The plasma display panel according to claim 1, wherein the resin has a content of 2 weight % to 3 weight %.

4. The plasma display panel according to claim 1, wherein the plasticizer includes at least one of dioctyl phthalate (DOP) or dibutyl phthalate (DBP).

5. The plasma display panel according to claim 4, wherein the resin includes at least one of ethyl cellulose or acryl.

6. The plasma display panel according to claim 5, wherein the resin has a content of greater than 4 weight % to less than or equal to 15 weight %

7. The plasma display panel according to claim 5, wherein the resin has a content of 4 weight % to 15 weight %.

8. The plasma display panel according to claim 5, wherein the resin has a content of 2 weight % to 3 weight %.

9. The plasma display panel according to claim 1, wherein the resin includes at least one of ethyl cellulose or acryl.

10. The plasma display panel according to claim 1, wherein the resin has a content of greater than 4 weight % to less than or equal to 15 weight %.

11. The plasma display panel according to claim 1, wherein the first and second electrodes comprises:

first and second transparent electrodes; and first and second bus electrodes formed on the first and second transparent electrodes, respectively.

12. The plasma display panel of claim 1, wherein each of the first and second bus electrodes comprises a black layer and an electrode layer.

13. The plasma display panel of claim 1, wherein , wherein at least one barrier rib is made from a paste having a composition of a powder of 75 weight % to 85 weight %, a resin of 1 weight % to 2 weight % and a solvent of 15 weight % to 25 weight %.

14. The plasma display panel of claim 13, wherein the powder for at least one barrier rib comprises a parent glass, a filler and a pigment.

15. The plasma display panel of claim 14, wherein the parent glass comprises $PbO—SiO_2—Al_2O_3$, the filler comprises $Al_2O_3$ and the pigment comprises $TiO_2$.

16. The plasma display panel of claim 1, wherein a dielectric layer is formed over the at least one address electrode and the first electrode.

* * * * *